US008755715B2

(12) United States Patent
Mori et al.

(10) Patent No.: US 8,755,715 B2
(45) Date of Patent: Jun. 17, 2014

(54) IMAGE FORMING APPARATUS HAVING LED HEAD AND ROTATABLE COVER

(75) Inventors: Shogo Mori, Nagoya (JP); Junichi Yokoi, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 190 days.

(21) Appl. No.: 13/422,847

(22) Filed: Mar. 16, 2012

(65) Prior Publication Data

US 2012/0275819 A1 Nov. 1, 2012

(30) Foreign Application Priority Data

Apr. 26, 2011 (JP) ..... 2011-097892

(51) Int. Cl.

| | |
|---|---|
| ***G03G 21/18*** | (2006.01) |
| ***G03G 15/00*** | (2006.01) |
| ***G03G 15/01*** | (2006.01) |
| ***G03G 13/04*** | (2006.01) |

(52) U.S. Cl.

USPC ..... 399/112; 399/118; 347/118; 347/138

(58) Field of Classification Search

USPC ..... 399/112, 118, 125, 179, 223; 347/117, 347/118, 138, 152, 245, 263

IPC ..... G03G 15/011,15/0142, 15/325, 15/326, G03G 2215/0119, 15/0178

See application file for complete search history.

(56) References Cited

U.S. PATENT DOCUMENTS

| | | | | |
|---|---|---|---|---|
| 5,808,649 | A | 9/1998 | Shimanari et al. | |
| 6,389,260 | B1 * | 5/2002 | Kataoka et al. | 399/298 |
| 7,656,421 | B2 * | 2/2010 | Itabashi | 347/138 |
| 8,150,293 | B2 * | 4/2012 | Numagami et al. | 399/110 |
| 8,207,995 | B2 * | 6/2012 | Tamaru et al. | 347/242 |
| 8,238,764 | B2 * | 8/2012 | Funahashi | 399/12 |

FOREIGN PATENT DOCUMENTS

| | | | |
|---|---|---|---|
| JP | 05150607 | A * | 6/1993 |
| JP | H09-160333 | A | 6/1997 |
| JP | 11194564 | A * | 7/1999 |
| JP | 2003-112446 | A | 4/2003 |
| JP | 2007-065125 | A | 3/2007 |
| JP | 2008296379 | A * | 12/2008 |
| JP | 2010-164614 | A | 7/2010 |

* cited by examiner

*Primary Examiner* — Robert Beatty
(74) *Attorney, Agent, or Firm* — Baker Botts L.L.P.

(57) ABSTRACT

An image forming apparatus is provided, which includes a housing having a cover swingable around a rotational shaft, and first and second LED heads attached to the cover, a position of the first LED head relative to a first axis line around which a first photoconductive body is rotatable being more shifted toward the rotational shaft in a first direction than a position of the second LED head relative to a second axis line around which a second photoconductive body is rotatable, the first direction being a direction along which the first and second photoconductive bodies are arranged, the first and second axis lines being parallel to a second direction perpendicular to the first direction.

13 Claims, 7 Drawing Sheets

IMAGE FORMING APPARATUS HAVING LED HEAD AND ROTATABLE COVER

CROSS-REFERENCE TO RELATED APPLICATION

This application claims priority under 35 U.S.C. §119 from Japanese Patent Application No. 2011-097892 filed on Apr. 26, 2011. The entire subject matter of the application is incorporated herein by reference.

BACKGROUND

1. Technical Field

The following description relates to one or more image forming apparatuses having an LED head supported by a rotatable cover.

2. Related Art

An image forming apparatus has been known that includes exposure units (each of which includes an exposure head having a plurality of light-emitting elements such as LEDs) and process cartridges (each of which includes a photoconductive drum) alternately disposed in parallel. The known image forming apparatus further includes an access cover swingable around a swing axis that is provided at an upper side of the apparatus and parallel to rotational axis lines of the photoconductive drums. Each exposure head is connected with an inner surface of the access cover via a supporting member. Thereby, when the access cover is opened, the exposure heads are separated from the respective photoconductive drums. Meanwhile, when the access cover is closed, the exposure heads are put in proximity to the respective photoconductive drums.

SUMMARY

Nowadays, in the meantime, a more downsized image forming apparatus is demanded. Hence, it is required to reduce a distance between an exposure unit and a component disposed between the exposure unit and an exposure unit adjacent thereto inside the image forming apparatus, in a predetermined direction in which the exposure units are arranged.

However, in the known image forming apparatus, each exposure unit is disposed in the same position relative to the rotational axis line of a corresponding one of the photoconductive drums in the predetermined direction. Further, an exposure unit located closer to the swing axis of the access cover turns while drawing a turning trajectory of a larger curvature in response to a swing motion of the access cover.

Therefore, when the distance between each exposure unit and a corresponding component in the predetermined direction is reduced, an exposure unit closer to the swing axis of the access cover is more likely to contact a component disposed behind the exposure unit (at a side farther from the swing axis of the access cover). Thereby, a swing motion of the access cover might cause contact between an exposure unit and a component disposed behind it, and it might lead to an increased frictional resistance in an opening-closing operation for the access cover. Thus, it might result in worsened operability for a user to use the apparatus.

Aspects of the present invention are advantageous to provide one or more improved techniques for an image forming apparatus having exposure heads (e.g., LED heads) which techniques allow a user to open and close an access cover of the apparatus with more favorable operability.

According to aspects of the present invention, an image forming apparatus is provided, which includes a housing including a cover formed to extend along a first direction in a closed state where the cover is closed relative to the housing, the access cover being configured to be open and closed relative to the housing while swinging around a rotational shaft parallel to a second direction perpendicular to the first direction, the rotational shaft being provided at an end of the housing in the first direction, an image forming unit disposed in the housing to face the cover in the closed state, the image forming unit including a plurality of rotatable photoconductive bodies arranged along the first direction, each of the plurality of photoconductive bodies being configured such that an electrostatic latent image is formed thereon, the plurality of photoconductive bodies including a first photoconductive body configured to rotate around a first axis line parallel to the second direction, and a second photoconductive body opposed to the rotational shaft across the first photoconductive body in the first direction, the second photoconductive body being configured to rotate around a second axis line parallel to the second direction, and a plurality of LED heads attached to the cover, the plurality of LED heads including a first LED head configured to expose the first photoconductive body, and a second LED head configured to expose the second photoconductive body. A position of the first LED head relative to the first axis line is more shifted toward the rotational shaft in the first direction than a position of the second LED head relative to the second axis line.

According to aspects of the present invention, further provided is an image forming apparatus, which includes a housing including a cover formed to extend along a first direction in a closed state where the cover is closed relative to the housing, the access cover being configured to be open and closed relative to the housing while swinging around a rotational shaft parallel to a second direction perpendicular to the first direction, the rotational shaft being provided at an end of the housing in the first direction, an image forming unit disposed in the housing to face the cover in the closed state, the image forming unit including a plurality of rotatable photoconductive bodies arranged along the first direction, each of the plurality of photoconductive bodies being configured such that an electrostatic latent image is formed thereon, the plurality of photoconductive bodies including a first photoconductive body configured to rotate around a first axis line parallel to the second direction, and a second photoconductive body opposed to the rotational shaft across the first photoconductive body in the first direction, the second photoconductive body being configured to rotate around a second axis line parallel to the second direction, and a first development cartridge configured to accommodate development agent to be supplied to the first photoconductive body, and a second development cartridge configured to accommodate development agent to be supplied to the second photoconductive body, and a plurality of exposure heads attached to the cover, the plurality of exposure heads including a first exposure head configured to expose the first photoconductive body, and a second exposure head configured to expose the second photoconductive body. In the closed state, a distance between the first exposure head and the first development cartridge in the first direction is longer than a distance between the second exposure head and the second development cartridge in the first direction.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, a color printer 1 of an embodiment according to aspects of the present invention will be described with reference to the accompanying drawings.

<Overall Configuration of Color Printer>

Figure 1:
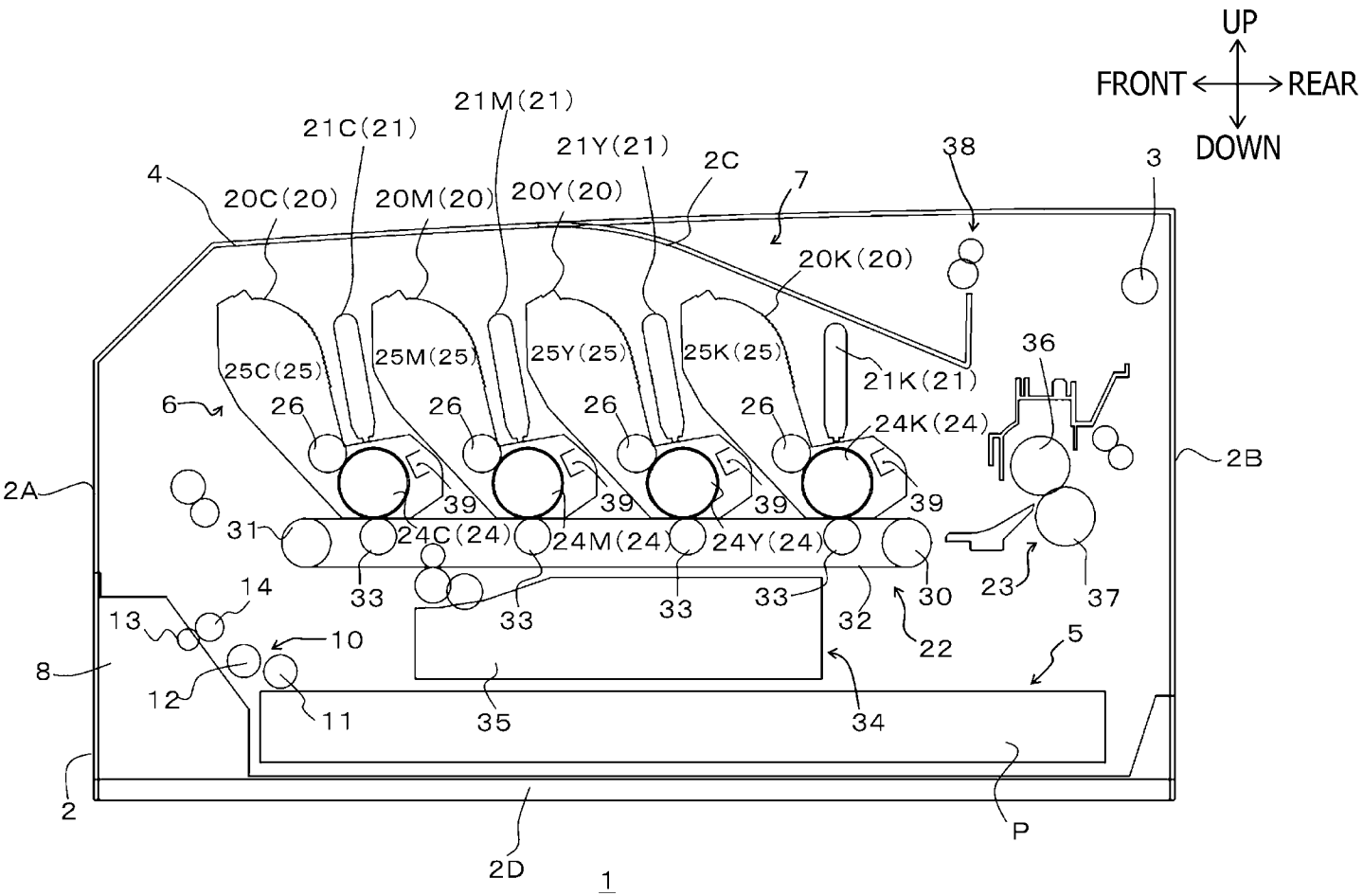
FIG. 1 is a cross-sectional side view schematically showing a configuration of a color printer in an embodiment according to one or more aspects of the present invention.

Referring to FIG. 1, an explanation will be provided about a configuration of the color printer 1 of the embodiment.

As shown in FIG. 1, the color printer 1 includes a main body housing 2, a feeding unit 5 configured to feed sheets P, an image forming unit 6 configured to form images on the sheets P fed by the feeding unit 5, and an ejecting unit 7 configured to eject the sheets P with the images formed thereon. The main body housing 2 includes a rear face 2B, a front face 2A opposed to the rear face 2B, an upper face 2C extending from an upper end of the rear face 2B to an upper end of the front face 2A (along the front-to-rear direction), and a lower face 2D opposed to the upper face 2C.

It is noted that in the following descriptions, the up-to-down direction (the vertical direction), the front-to-rear direction, and the left-to-right direction, unless specified otherwise, will be defined as indicated in the accompanying drawings.

(1) Feeding Unit

The feeding unit 5 includes a feed tray 8 detachably attached to the main body housing 2 at a lower side of the main body housing 2, and a sheet feeding mechanism 10 configured to feed the sheets P from the feed tray 8 to the image forming unit 6.

The sheet feeding mechanism 10 includes a feed roller 11 and a separation roller 12. The sheet feeding mechanism 10 feeds the sheets P upward in a manner separated on a sheet-by-sheet basis by the feed roller 11 and the separation roller 12. The sheet P fed upward has sheet powder removed therefrom during a process of passing between a paper powder removing roller 13 and a pinch roller 14. Thereafter, the sheet P is directed rearward and supplied onto a belt 32.

(2) Image Forming Unit

The image forming unit 6 includes a plurality of process units 20 (20C, 20M, 20Y, and 20K). Exposure units 21 (21C, 21M, 21Y, and 21K) are provided for the process units 20, respectively. A transfer unit 22 is disposed under the process units 20. A fixing unit 23 is disposed downstream relative to the process units 20 in a feeding direction of the sheet P.

The process units 20 include photoconductive drums 24 (24C, 24M, 24Y, and 24K), toner containers 25 (25C, 25M, 25Y, and 25K), and development rollers 26, respectively. The photoconductive drums 24 are arranged along the front-to-rear direction in parallel with each other. The photoconductive drums 24 are configured to rotate around rotational axis lines 24A (24AC, 24AM, 24AY, and 24AK) (see FIG. 2) extending along the left-to-right direction, respectively. The toner containers 25 are configured to accommodate cyan toner, magenta toner, yellow toner, and black toner, respectively.

Each development roller 26 is disposed to contact the corresponding photoconductive drum 24 at an upper front side of the photoconductive drum 24.

In each process unit 20, when a surface of the photoconductive drum 24 is charged by a scorotron charger 39 and an area of the charged surface of the photoconductive drum 24 is exposed to light emitted by the exposure unit 21, the electrical potential of the exposed area is lowered. Thereby, an electrostatic latent image based on image data is formed on the photoconductive drum 24. Further, when the electrostatic latent image is supplied with charged toner from the development roller 26, a toner image is formed on the photoconductive drum 24.

The plurality of exposure units 21 are provided to expose the photoconductive drums 24, respectively. The exposure units 21 and the process units 20 are alternately disposed along the direction in which the process units 20 are arranged. Specifically, the exposure units 21 and the process units 20 are arranged in the order, from the rear end, of the exposure unit 21K, the process unit 20K, the exposure unit 21Y, the process unit 20Y, the exposure unit 21M, the process unit 20M, the exposure unit 21C, and the process unit 20C. Each exposure unit 21 is configured with the same components.

Each exposure unit 21 is connected with a top cover 4, which is rotatable around a rotational shaft 3 provided at a rear side of the main body housing 2. Thereby, each exposure unit 21 is movable between an exposure position where the exposure unit 21 is allowed to expose the corresponding photoconductive drum 24 and an evacuation position that the exposure unit 21 reaches after evacuating from the photoconductive drum 24 toward the upper face 2C.

Figure 2:
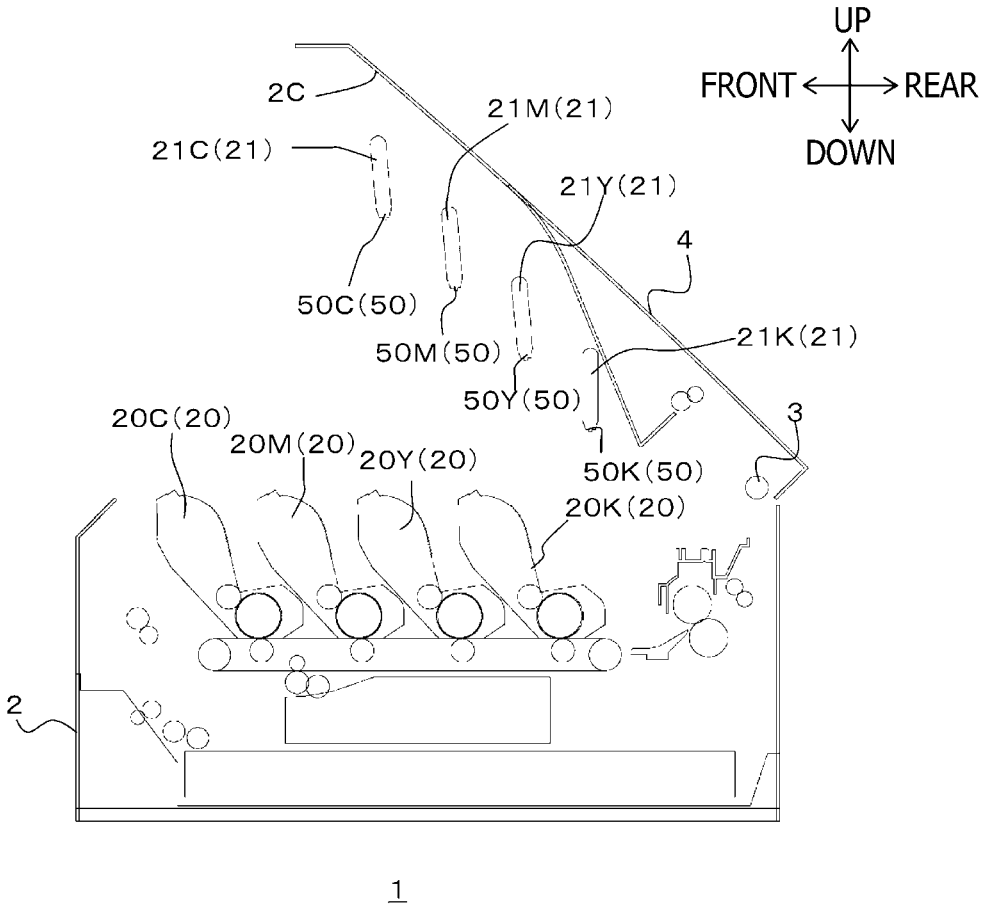
FIG. 2 is a cross-sectional side view of the color printer in a state where a top cover is open in the embodiment according to one or more aspects of the present invention.

Specifically, each exposure unit 21 is attached to the top cover 4 so as to swing around a below-mentioned corresponding head rotational shaft 60 in response to rotation of the top cover 4. More specifically, the exposure unit 21 swings upward from the state shown in FIG. 1 when a front end of the top cover 4 is turned upward around the rotational shaft 3. However, the exposure unit 21 does not swing around the head rotational shaft 50 during a time when a below-mentioned corresponding LED head 50 is located between two adjacent process units 20 in the front-to-rear direction. Namely, the exposure unit 21 is supported by the top cover 4 so as to form a predetermined angle with respective to a direction in which the top cover 4 extends. When the top cover 4 is further turned upward, the LED head 50 is pulled out from between the process units 20. Thereafter, as shown in FIG. 2, in response to rotation of the top cover 4, the exposure unit 21 swings around the head rotational shaft 60 such that the LED head 50 is directed to the rotational shaft 3.

It is noted that in the state where the top cover 4 is closed (see FIG. 1), the rotational shaft 3 is disposed above the below-mentioned LED heads 50 (see FIG. 2) when viewed along the left-to-right direction. In the state where the top cover 4 is open with respect to the min body housing 2, the process units 20 are allowed to be detached from the main body housing 2.

The transfer unit 22 includes a driving roller 30, a driven roller 31, a belt 32, transfer rollers 33, and a cleaning unit 34.

The driving roller 30 and the driven roller 31 are disposed to be spaced away from and parallel to each other. The endless belt 32 is wound around the pair of rollers 30 and 31. The transfer rollers 33 are disposed inside the endless belt 32. The transfer rollers 33 and the photoconductive drums 24 are configured to pinch the belt 32 therebetween. Each transfer roller 33 is supplied with a transfer bias from a high-voltage board (not shown). In an image forming operation, the sheet P being conveyed on the belt 32 is pinched between the photoconductive drums 24 and the transfer rollers 33 via the belt 32. Then, the toner images on the photoconductive drums 24 are transferred onto the sheet P.

The cleaning unit 34 is disposed under the belt 32. The cleaning belt 34 is configured to remove toner adhering onto the belt 32 and drop the removed toner down to a toner storage section 35 disposed in a lower part of the cleaning unit 34.

The fixing unit 23 is disposed downstream relative to the transfer unit 22 in the feeding direction, i.e., disposed in a rear part of the min body housing 2. The fixing unit 23 includes a heating roller 36 and a pressing roller 37. The heating roller 36 includes therein a halogen lamp, which is configured to heat a surface of the heating roller 36 to a predetermined fixing temperature. The pressing roller 37 is disposed to contact the heating roller 36 under a pressure. The pressing roller 37 is configured to feed the sheet P while pinching the sheet P between the heating roller 36 and the pressing roller 37 and thereby thermally fix the toner images on the sheet P.

The ejection unit 7 includes a plurality of ejection rollers 38 configured to feed the sheet P. The sheet P ejected by the ejection rollers 38 is put (stacked on an earlier-ejected sheet P) on the upper face 2C (a catch tray) of the main body housing 2.

<Structure of Exposure Units>

Figure 3:
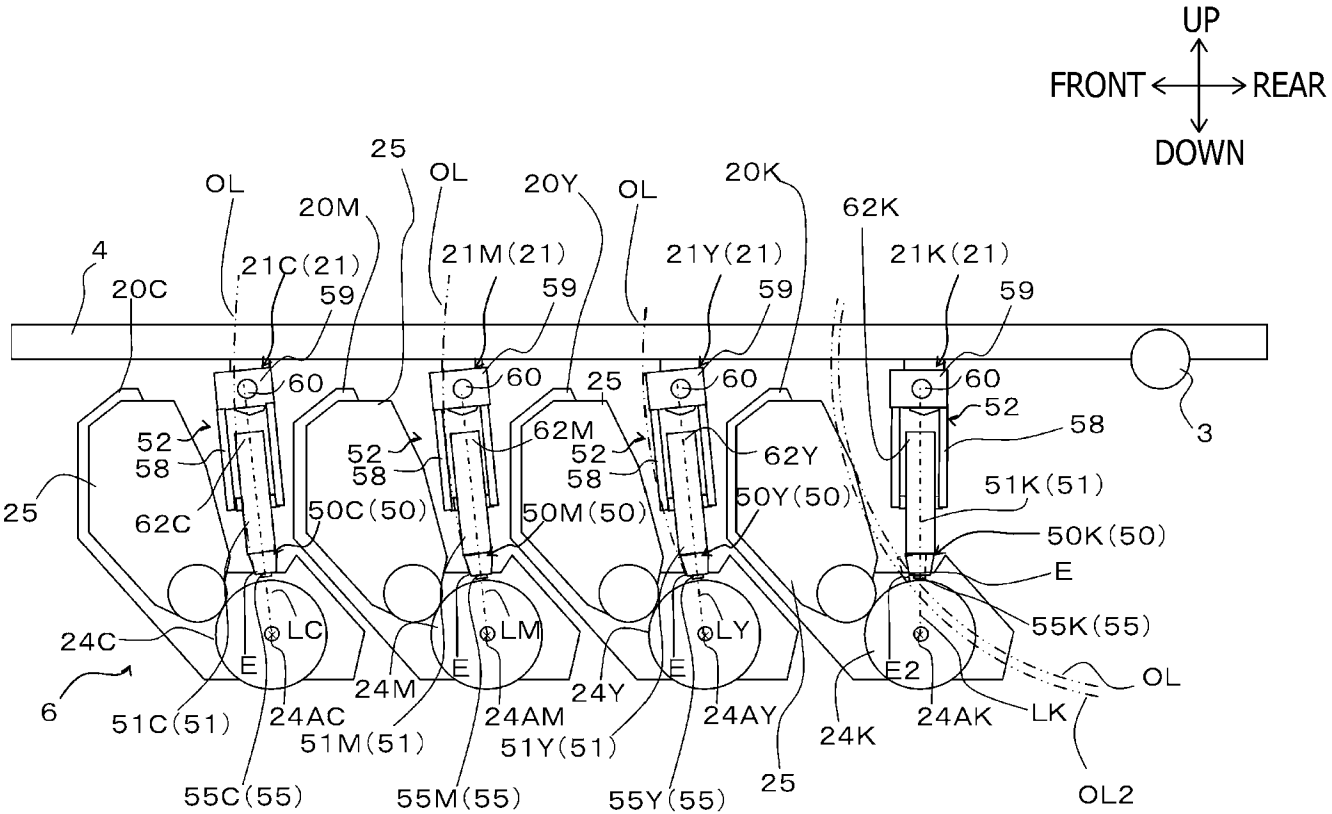
FIG. 3 is a side view schematically showing an image forming unit, the top cover, and exposure units in the embodiment according to one or more aspects of the present invention.

Subsequently, referring to FIG. 3, a structure of the exposure units 21 will be described. As shown in FIG. 3, the exposure units 21 include the LED heads 50 (50C, 50M, 50Y, and 50K), holding members 51 (51C, 51M, 51Y, and 51K), and supporting bodies 52, respectively. In FIG. 3, the top cover 4 is closed relative to the main body housing 2, and each exposure unit 21 is in the exposure position where the exposure unit 21 is allowed to expose the corresponding photoconductive drum 24.

The LED heads 50 include LED arrays (not shown), each of which has a plurality of light-emitting diodes (LEDs) arranged linearly along the left-to-right direction, and lens arrays 55 (55C, 55M, 55Y, and 55K), respectively. Each lens array 55 is configured to converge light emitted by the LED array on the surface of the photoconductive drum 24. Each lens array 55 extends along the left-to-right direction along which the LED arrays are arranged. Each lens array 55 is disposed to face the corresponding LED array.

Each holding member 51 is a resin member formed in a rectangular shape when viewed along the left-to-right direction. Each holding member 51 is located in a position higher than the LED head 50. Each holding member 51 extends substantially in the vertical direction between two adjacent process units 20 (except for the rearmost holding member 51, which is not between two process units 20) in the front-to-rear direction. Each holding member 51 is configured to hold the LED head 50 over a predetermined length of the LED head 50 in the left-to-right direction, at an end of the holding member 50 in the vertical direction which end is close to the photoconductive drum 24.

Each supporting body 52 includes a supporting portion 58 that supports the holding member 51, and a joint portion 59 connected with the top cover 4. The supporting portion 58 is a pair of resin plate members that support the holding member 51 to pinch the holding member 51 therebetween in the front-to-rear direction at lower ends thereof. The joint portion 59, which extends in the left-to-right direction, is formed integrally with an upper end of the supporting portion 58. The joint portion 59 includes a hole formed substantially in a central position thereof in the front-to-rear direction and is rotatable around the head rotational shaft 60 inserted through the hole.

As shown in FIG. 3, each exposure unit 21 is attached to the top cover 4 to form a predetermined angle with respect to the vertical direction at the exposure position. Specifically, the LED heads 50 (50C, 50M, 50Y, and 50K) are attached to the holding members 51 such that straight lines L (LC, LM, LY, and LK), which connect the lens arrays 55 with the rotational axis lines 24A as indicated by alternate long and short dash lines in FIG. 3, form the predetermined angle with respect to the vertical direction when viewed along the left-to-right direction, respectively. Each straight line L connects the lens array 55 and the rotational axis line 24A by the most direct way. Namely, each straight line L corresponds to an optical axis of the LED head 50 when viewed along the left-to-right direction.

As shown in FIG. 3, the straight lines LC, LM, and LY are inclined forward at the same angle (6 degrees) with respect to the rotational axis lines 24AC, 24AM, and 24AY of the photoconductive drums 24C, 24M, and 24Y, respectively. Namely, the LED heads 50C, 50M, and 50Y are disposed in an inclined manner to be turned forward around the rotational axis lines 24AC, 24AM, and 24AY of the photoconductive drums 24C, 24M, and 24Y, respectively. It is noted that the four process units 20 are arranged at intervals of a constant distance in the front-to-rear direction.

The straight line LK is substantially parallel to the vertical direction. Namely, the position of the LED head 50K relative to the rotational axis line 24AK is the same position as if the other LED heads 50C, 50M, and 50Y were turned toward the rotational shaft 3 around the rotational axis lines 24AC, 24AM, and 24AY of the photoconductive drums 24C, 24M, and 24Y, respectively.

At this time, the exposure unit 21K is disposed to be more inclined such that a below-mentioned farthest portion E of the LED head 50K, which portion is close to the process unit 20K, is separated farther from the process unit 20K. The holding members 51C, 51M, 51Y, and 51K are supported by the supporting bodies 52 to be located on the straight lines LC, LM, LY, and LK, respectively.

Here, an explanation will be provided about the process units 20K and 20Y. As shown in FIG. 3, the process units 20K and 20Y include the photoconductive drums 24K and 24Y, respectively. The LED heads 50K and 50Y are opposed to the photoconductive drums 24K and 24Y, respectively.

The exposure units 21K and 21Y include the LED heads 50K and 50Y, respectively. As described above, the exposure unit 21K is disposed to be more inclined toward the rotational shaft 3 in comparison with the exposure units 21C, 21M, and 21Y. More specifically, the holding member 51K is more inclined such that a cover-side end 62K thereof, which is an end opposite to the LED head 50K and close to the top cover 4, is located in the same position as if a cover-side end 62Y of the holding member 51Y, which end is opposite to the LED head 50Y and close to the top cover 4, were displaced toward the rotational shaft 3. Further, in the front-to-rear direction, the position of the LED head 50K relative to the rotational axis line 24AK is more shifted toward the rotational shaft 3 than the position of the LED head 50Y relative to the rotational axis line 24AY.

In the color printer 1 configured as above, a trajectory of each exposure unit 21 turning when the top cover 4 is opened and closed is indicated by a chain double-dashed line in FIG. 3. In FIG. 3, a turning trajectory of the farthest portion E of each exposure unit 21 that is a portion farthest from the rotational shaft 3 is shown. Each farthest portion E is a lower front end of the corresponding LED head 50. Additionally, FIG. 3 shows a turning trajectory OL2 of a farthest portion E2 of the LED head 50K assumed to be attached at the same angle as the LED heads 50C, 50M, and 50Y.

As shown by each turning trajectory OL, when the top cover 4 is swung upward, each LED head 50 moves in an arc upward from the exposure position and passes between two adjacent process units 20 while passing by the toner containers 25 of the process units 20.

As shown in FIG. 3, the LED head 50K is disposed to be more inclined rearward such that the straight line LK is more turned clockwise (in FIG. 3) around the rotational axis line 24AK of the photoconductive drum 24A, in comparison with the LED heads 50C, 50M, and 50Y. Therefore, the farthest portion E of the LED head 50K is closer to the rotational shaft 3 than the farthest portion E2. Accordingly, the turning trajectory OL of the farthest portion E of the LED head 50K has a smaller radius than the turning trajectory OL2 of the farthest portion E2.

The color printer 1 configured as above provides the following effects.

The holding member 51K is more inclined toward the rotational shaft 3 such that the cover-side end 62K, which is an end opposite to the LED head 50K and close to the top cover 4, is located in the same position as if the cover-side end 62Y of the holding member 51Y, which end is opposite to the LED head 50Y and close to the top cover 4, were displaced toward the rotational shaft 3. Further, in the front-to-rear direction, the position of the LED head 50K relative to the rotational axis line 24AK is more shifted toward the rotational shaft 3 than the position of the LED head 50Y relative to the rotational axis line 24AY. Hence, the farthest portion E of the LED head 50K is separated farther from the process unit 20K. Thereby, it is possible to shift the turning trajectory of the farthest portion E of the LED head 50K from the side of the process unit 20K toward the rotational shaft 3. Thus, it is possible to reduce the risk of contact (interference) between the process unit 20K and the exposure unit 21K that might be caused when the top cover 4 is opened and closed and improve operability for the user to use the color printer 1.

Further, the exposure unit 21K, which is one of the exposure units 21 closest to the rotational shaft 3, is more inclined toward the rotational shaft 3 than any other exposure units 21. Thereby, since the turning trajectory OL of the farthest portion E of the LED head 50K as one of the LED heads 50 closest to the rotational shaft 3 has the largest radius, it is possible to more efficiently reduce the risk of contact (interference) between the process unit 20K and the exposure unit 21K.

Further, the process unit 20K for the black toner is disposed closest to the rotational shaft 3, and only the exposure unit 21K is disposed to be more inclined so as to make the cover-side end 62K closer to the rotational shaft 3. On the other hand, the exposure units 21C, 21M, and 21Y are disposed to form the same angle relative to the vertical direction. Thereby, it is possible to make identical to each other respective relative positions on the circumferential surfaces of the photoconductive drums 24C, 24M, and 24Y which positions are exposed by the exposure units 21C, 21M, and 21Y. Thus, it is possible to perform favorable image formation.

Further, the rotational shaft 3 is located between the top cover 4 and the LED heads 50 in the vertical direction when viewed along the left-to-right direction. According to the color printer 1 configured as above, the turning trajectories OL of the LED heads 50 pass through positions closer to the respective corresponding process units 20. Thus, according to the color printer 1 configured as above, since the exposure unit 21K is more inclined rearward (than any other exposure units 21) so as to be farther from the process unit 20K, it is possible to more efficiently reduce the risk of contact (interference) between the LED head 50K and the process unit 20K.

Further, as the LED head 50K is turned rearward around the rotational axis line 24AK of the photoconductive drum 24K, the position of the LED head 50K relative to the rotational axis line 24AK is more shifted toward the rotational shaft 3 than the position of the LED head 50Y relative to the rotational axis line 24AY. Thereby, the LED head 50K is allowed to emit light to be perpendicularly incident onto the photoconductive drum 24K. Thus, it is possible to perform favorable image formation.

Further, the process units 20 and the toner containers 25 are arranged along the horizontal direction. Thereby, it is possible to downsize the color printer 1 in the vertical direction.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

First Modification

Figure 4:
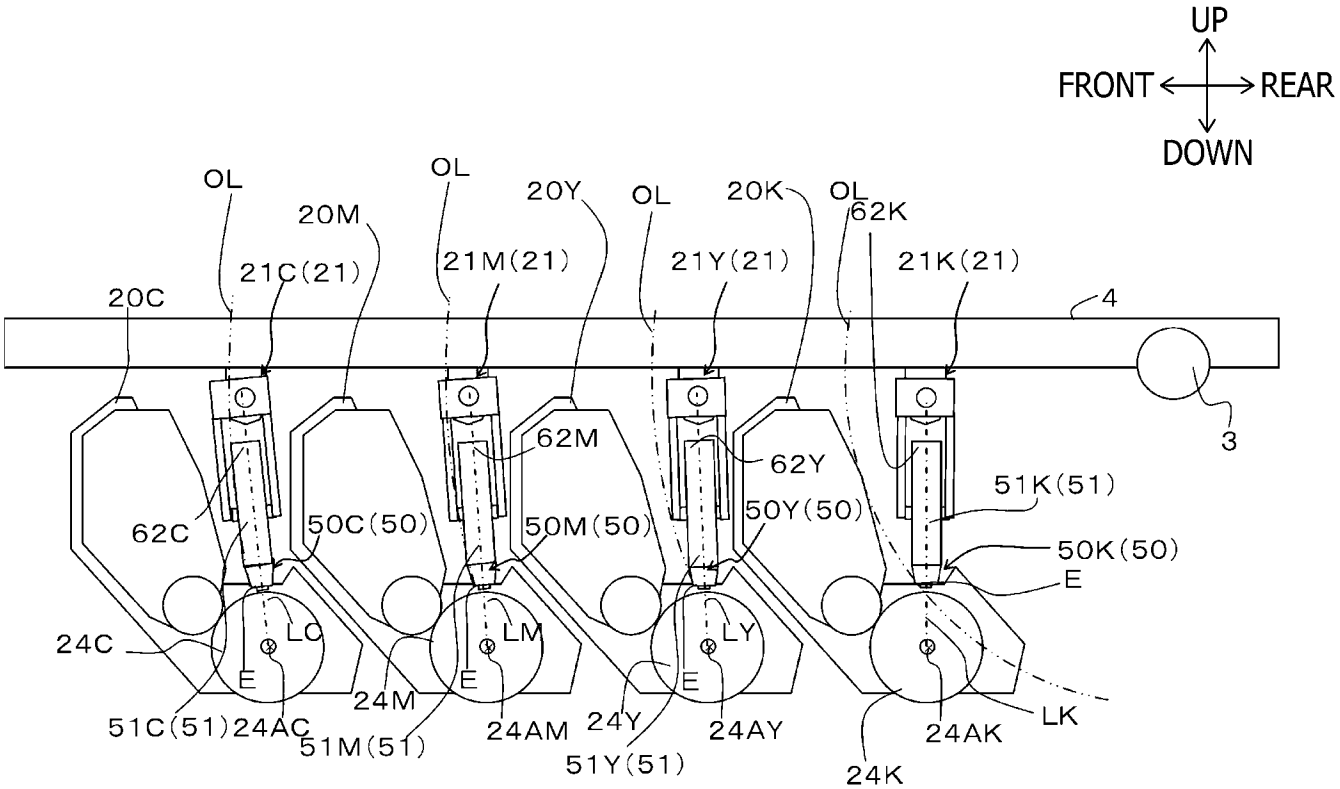
FIG. 4 is a side view schematically showing an image forming unit, a top cover, and exposure units in a first modification according to one or more aspects of the present invention.

Subsequently, an explanation will be provided about a first modification according to aspects of the present invention with reference to FIG. 4. In the first modification, the exposure units 21 are provided to form respective different angles relative to the vertical direction.

Specifically, the straight lines LC, LM, LY, and LK are inclined as an LED head 50 closer to the rotational shaft 3 is more turned rearward around the rotational axis line 24A of a corresponding photoconductive drum 24. In other words, an LED head 50 closer to the rear end of the color printer 1 has a relative position, to a corresponding rotational axis line 24A, more shifted toward the rotational shaft 3.

For example, the LED head 50C is provided to the holding member 51C such that the straight line LC is inclined forward around the rotational axis line 24AC to form an angle of 6 degrees relative to the vertical direction. The LED head 50M is provided to the holding member 51M such that the straight line LM is inclined forward around the rotational axis line 24AM to form an angle of 4 degrees relative to the vertical direction. The LED head SOY is provided to the holding member 51Y such that the straight line LY is inclined forward around the rotational axis line 24AY to form an angle of 2 degrees relative to the vertical direction. The LED head 50K is provided to the holding member 51K such that the straight line LK is substantially parallel to the vertical direction.

The holding members 51C, 51M, 51Y, and 51K are disposed on the straight lines LC, LM, LY, and LK, respectively, when viewed along the left-to-right direction.

The first modification provides the following effects.

The position of an LED head 50 closer to the rear end of the color printer 1 relative to a corresponding to rotational axis line 24A is more shifted toward the rotational shaft 3. Thereby, it is possible to dispose each exposure unit 21 inclined at such an appropriate angle relative to the vertical direction as to reduce the risk of contact (interference) with the process unit 20 in front of the exposure unit 21, depending on the turning trajectory of the exposure unit 21.

Second Modification

Figure 5:
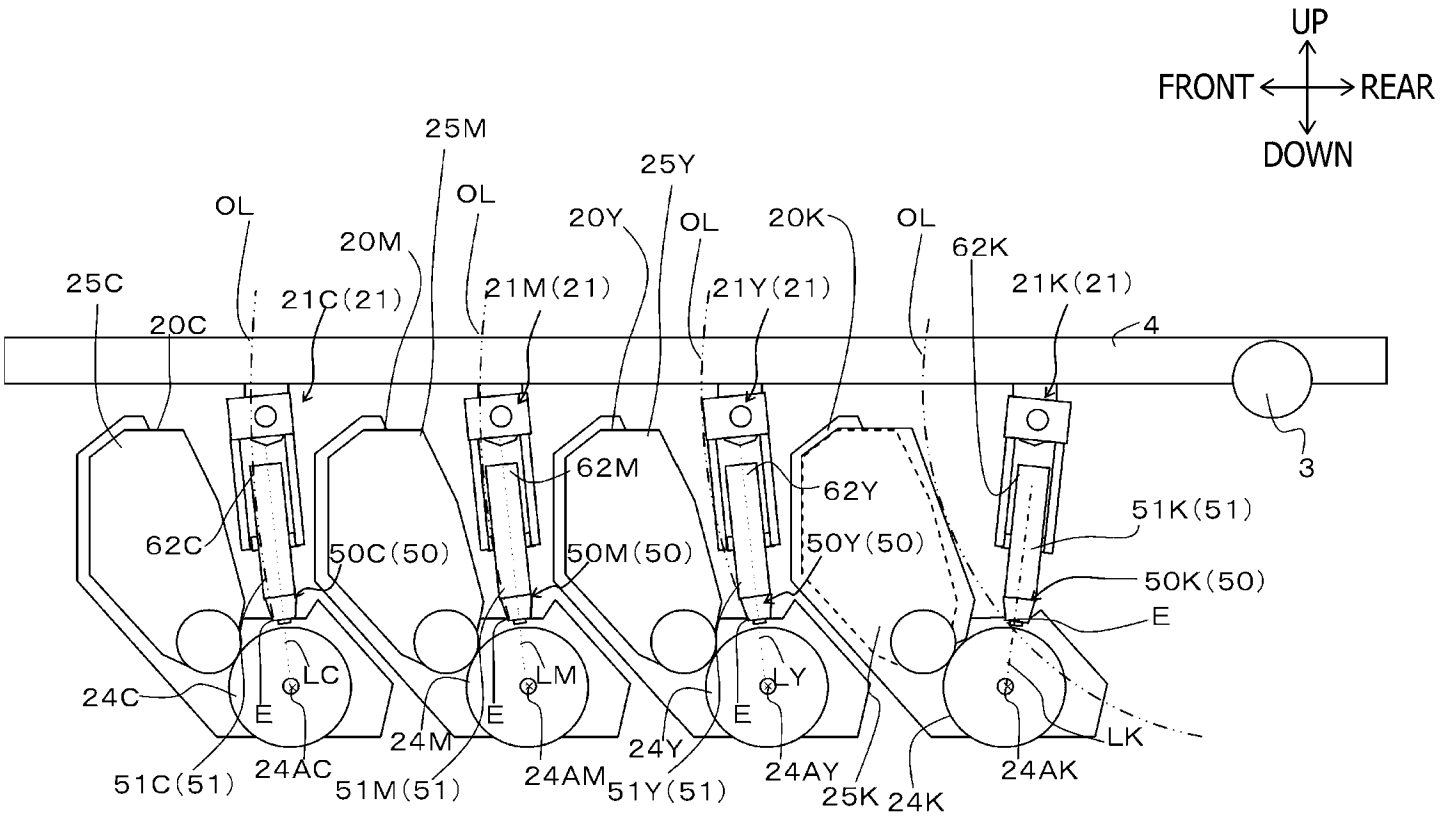
FIG. 5 is a side view schematically showing an image forming unit, a top cover, and exposure units in a second modification according to one or more aspects of the present invention.

Subsequently, an explanation will be provided about a second modification according to aspects of the present invention with reference to FIG. 5. In the second modification, as shown in FIG. 5, the exposure unit 21K is inclined toward the rotational shaft 3 with respect to the vertical direction.

Specifically, the LED head 50K is provided to the holding member 51 such that the straight line LK is inclined toward the rotational shaft 3 around the rotational axis line 24A with respect to the vertical direction. In the second modification, the straight line LK is inclined toward the rotational shaft 3 at an angle of 6 degrees relative to the vertical direction. The straight lines LC, LM, and LY are inclined in the same manner as the aforementioned embodiment. Namely, the straight lines LC, LM, and LY are inclined forward at an angle of 6 degrees around the respective rotational axis lines 24A. Thereby, the farthest portion E of the LED head 50K is made closer to the rotational shaft 3 than that of the aforementioned embodiment.

Thereby, in the second modification, the turning trajectory OL of the farthest portion E of the LED head 50K has a smaller radius than that of the aforementioned embodiment and passes through positions farther from the process unit 20K.

The second modification provides the following effects.

Thus, the LED head 50K is inclined rearward such that the farthest portion E thereof is separated farther from the process unit 20K. Specifically, the LED head 50K is disposed to be closer to the rotational shaft 3 than a vertical linear line passing through the rotational axis line 24AK. Thereby, the turning trajectory OL of the LED head 50K is separated farther from the process unit 20K (to create a space between the turning trajectory OL and the process unit 20K). By utilizing such a created space, it is possible to attain an increased storage capacity of the toner container 25 of the process unit 20K. Thereby, the user is allowed to replace the process unit 20K less frequently. It is noted that, in FIG. 5, a dashed line indicating the outline (size) of the toner container 25Y is added onto the toner container 25K for comparison in FIG. 5.

Third Modification

Figure 6:
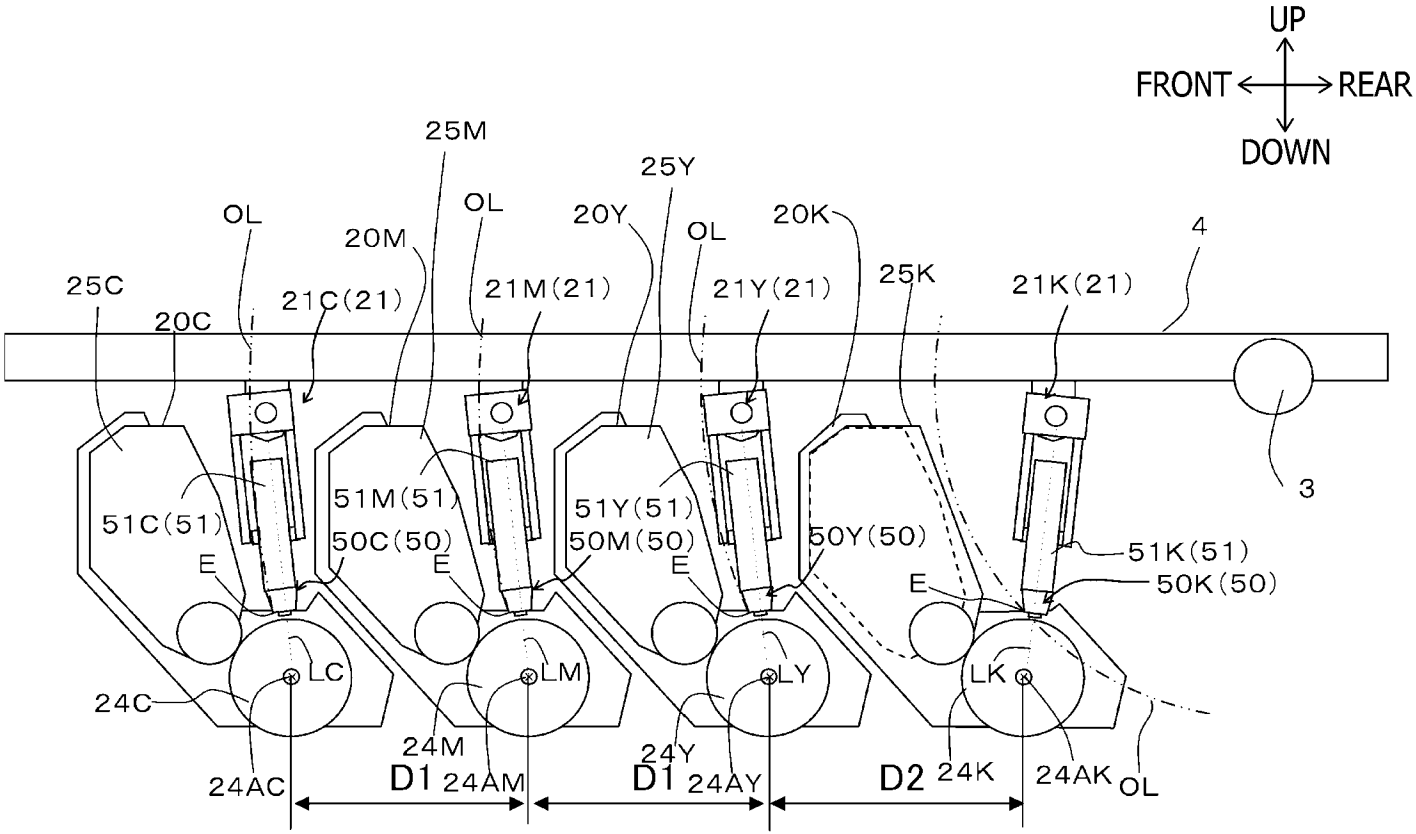
FIG. 6 is a side view schematically showing an image forming unit, a top cover, and exposure units in a third modification according to one or more aspects of the present invention.

Subsequently, an explanation will be provided about a third modification according to aspects of the present invention with reference to FIG. 6. In the third modification, as shown in FIG. 6, the exposure unit 21K is inclined toward the rotational shaft 3 with respect to the vertical direction.

Specifically, the LED head 50K is provided to the holding member 51 such that the straight line LK is inclined toward the rotational shaft 3 around the rotational axis line 24A with respect to the vertical direction. In the third modification, the straight line LK is inclined toward the rotational shaft 3 at an angle of 6 degrees relative to the vertical direction. Thereby, the farthest portion E of the LED head 50K is separated farther from the process unit 20K. The straight lines LC, LM, and LY are inclined in the same manner as the aforementioned embodiment. Namely, the straight lines LC, LM, and LY are inclined forward at an angle of 6 degrees around the respective rotational axis lines 24A (24AC, 24AM, and 24AY).

Further, in the third modification, a distance between the photoconductive drum 24K and the photoconductive drum 24Y in the front-to-rear direction is longer than that between any other adjacent two photoconductive drums 24. Specifically, as shown in FIG. 6, the distance between the rotational axis line 24AC of the photoconductive drum 24C and the rotational axis line 24AM of the photoconductive drum 24M is a distance D1. In the same manner, the distance between the rotational axis line 24AM of the photoconductive drum 24M and the rotational axis line 24AY of the photoconductive drum 24Y is the distance D1. Meanwhile, the distance between the rotational axis line 24AY of the photoconductive drum 24Y and the rotational axis line 24AK of the photoconductive drum 24K is a distance D2 longer than the distance D1.

Thereby, the exposure unit 21K is disposed to be closer to the rotational shaft 3 in comparison with the aforementioned embodiment. Hence, the farthest portion E of the LED head 50K is located at a shorter distance from the rotational shaft 3. Accordingly, in the third modification, the turning trajectory OL of the farthest portion E of the LED head 50K runs at a shorter distance from the rotational shaft 3 in comparison with the aforementioned embodiment. Meanwhile, the distance between any adjacent two toner containers 25 in the front-to-rear direction is identical to that in the aforementioned embodiment. Therefore, the turning trajectory OL of the LED head 50K passes through positions farther from the process unit 20K and closer to the rotational shaft 3 in comparison with the aforementioned embodiment. Thus, it is possible to attain an increased storage capacity of the toner container 25 of the process unit 20K. It is noted that, in FIG. 6, a dashed line indicating the outline (size) of the toner container 25Y is added onto the toner container 25K for comparison.

Other Modifications

In the aforementioned embodiment, the rotational shaft 3 is disposed behind the image forming unit 6. However, the rotational shaft 3 may be disposed ahead of the image forming unit 6.

In the aforementioned embodiment, the LED heads 50 are employed as exposure heads. However, other light sources such as electroluminescence devices and fluorescence substances may be employed.

In the aforementioned embodiment, the exposure units 21 are rotatable relative to the top cover 4. However, the exposure units 21 may be fixed to the top cover 4.

In the aforementioned embodiment, the farthest portions E are included in the LED heads 50. However, the farthest portions E may be included in the holding members 51 or the supporting bodies 52.

Figure 7:
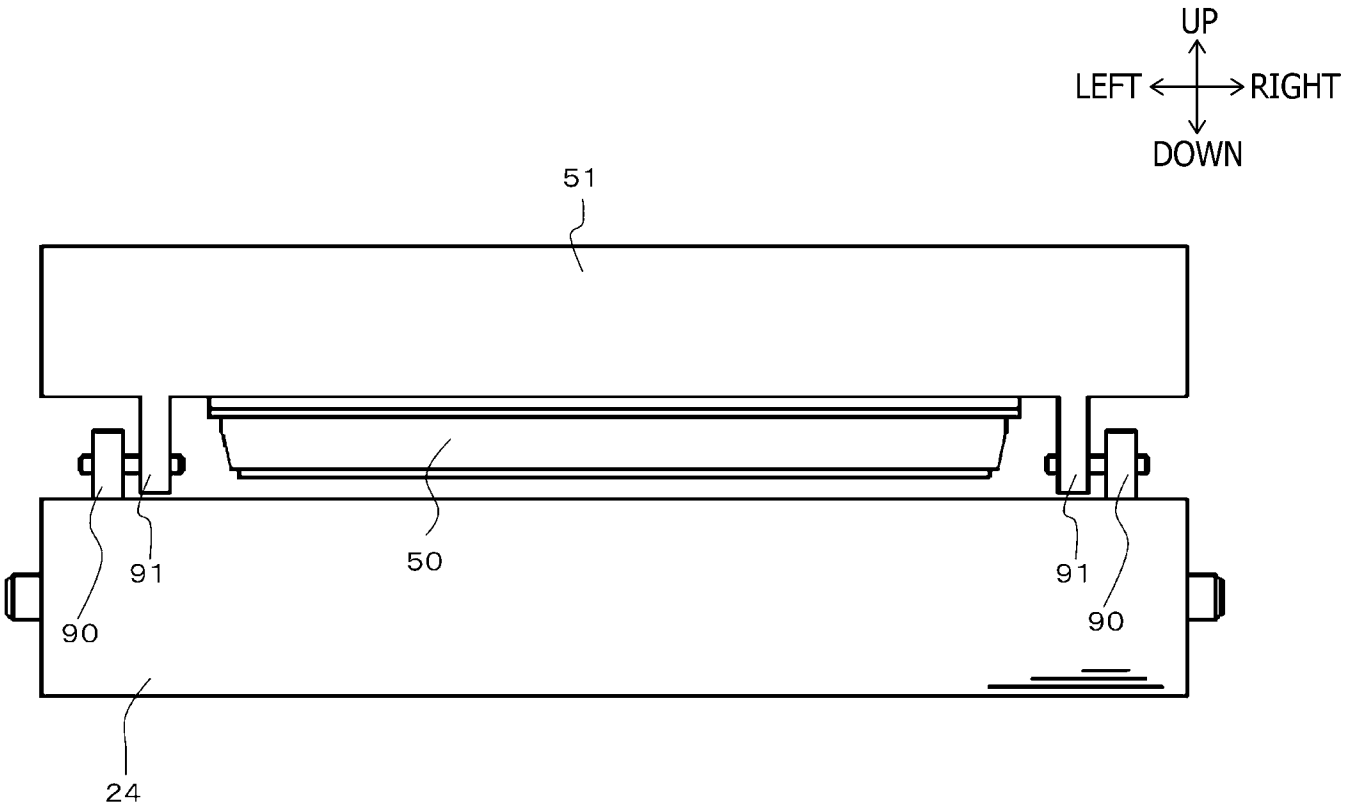
FIG. 7 is a front view schematically showing a holding member, an LED head, and a photoconductive drum in another modification according to one or more aspects of the present invention.

Further, as shown in FIG. 7, each holding member 51 may include two rotatable rollers 90 provided to face each other across the LED head 50 in the left-to-right direction. The rollers 90 may be rotatably attached to roller supporting portions 91 that extend downward from both ends of the holding member 51 in the left-to-right direction. The rollers 90 may be configured to contact the circumferential surface of the photoconductive drum 24 and maintain constant the distance between the LED head 50 and the photoconductive drum 24. Thereby, it is possible to precisely position the LED head 50 relative to the photoconductive drum 24.

What is claimed is:

1. An image forming apparatus comprising:

a housing comprising:

a cover formed to extend along a first direction in a closed state where the cover is closed relative to the housing, the cover being configured to be open and closed relative to the housing while swinging around a rotational shaft parallel to a second direction perpendicular to the first direction, the rotational shaft being provided at an end of the housing in the first direction;

an image forming unit disposed in the housing to face the cover in the closed state, the image forming unit comprising a plurality of rotatable photoconductive bodies arranged along the first direction, each of the plurality of photoconductive bodies being configured such that an electrostatic latent image is formed thereon, the plurality of photoconductive bodies comprising:

a first photoconductive body configured to rotate around a first axis line parallel to the second direction; and a second photoconductive body opposed to the rotational shaft wherein the first photoconductive body is spaced from the second photoconductive body in the first direction, the second photoconductive body being configured to rotate around a second axis line parallel to the second direction; and a plurality of LED heads attached to the cover, the plurality of LED heads comprising:

a first LED head configured to expose the first photoconductive body; and a second LED head configured to expose the second photoconductive body, wherein a first line formed from the first axis line through the first LED head intersects with a second line parallel to the first direction extending from an end of the housing opposite the rotational shaft to a point at which the first line intersects the second line to form a first angle, wherein a third line formed from the second axis line through the second LED head intersects with a fourth line parallel to the first direction extending from the end of the housing opposite the rotational shaft to a point at which the third line intersects the fourth line to form a second angle, and wherein the second angle is greater than the first angle.

2. The image forming apparatus according to claim 1, wherein the rotational shaft is disposed between the cover and the plurality of LED heads in a direction perpendicular to the first and second directions.

3. The image forming apparatus according to claim 1, wherein the image forming unit comprises a plurality of process units arranged along the first direction, each of the plurality of process units comprising one of the plurality of photoconductive bodies, and wherein the plurality of process units and the plurality of LED heads are alternately disposed in the first direction.

4. The image forming apparatus according to claim 3, wherein the plurality of process units comprise a first process unit comprising the first photoconductive body, and wherein the first process unit is opposed to the rotational shaft across the first LED head in the first direction.

5. The image forming apparatus according to claim 4, wherein any one, of the plurality of LED heads, other than the first LED head has a same position relative to a rotational axis line of a corresponding one of the plurality of photoconductive bodies in the first direction.

6. The image forming apparatus according to claim 5, wherein each of the plurality of process units is configured to accommodate development agent for developing the electrostatic latent image formed on a corresponding one of the plurality of photoconductive bodies, wherein the first process unit is configured to accommodate black development agent, and wherein any one of the plurality of process units other than the first process unit is configured to accommodate development agent of a color.

7. The image forming apparatus according to claim 4, wherein the first process unit has a larger storage capacity for accommodating the development agent than any one of the plurality of process units other than the first process unit.

8. The image forming apparatus according to claim 1, wherein one of the plurality of LED heads that is closer to the rotational shaft has a position that is downstream in a rotational direction of the plurality of photoconductive bodies around a rotational axis line of a corresponding one of the plurality of photoconductive bodies from a rotational position of another of the plurality of LED heads.

9. The image forming apparatus according to claim 1, wherein a position of the first LED head relative to the first axis line is downstream in a rotational direction of the plurality of photoconductive bodies from a position of the second LED head around the second axis line.

10. The image forming apparatus according to claim 1, wherein the first direction is a horizontal direction.

11. The image forming apparatus according to claim 3, wherein the plurality of process units comprise developer containers configured to accommodate development agent, respectively, wherein the developer containers are disposed between the cover and the plurality of LED heads in a direction perpendicular to the first and second directions, and wherein the developer containers and the plurality of LED heads are alternately disposed in the first direction.

12. The image forming apparatus according to claim 11, wherein the plurality of photoconductive bodies comprise a third photoconductive body that is adjacent to the second photoconductive body and opposed to the first photoconductive body across the second photoconductive body, wherein the developer containers are arranged at intervals of a predetermined constant distance in the first direction, and wherein a distance between the first photoconductive body and the second photoconductive body is longer than a distance between the second photoconductive body and the third photoconductive body.

13. An image forming apparatus comprising:

a housing comprising:

a cover formed to extend along a first direction in a closed state where the cover is closed relative to the housing, the cover being configured to be open and closed relative to the housing while swinging around a rotational shaft parallel to a second direction perpendicular to the first direction, the rotational shaft being provided at an end of the housing in the first direction;

an image forming unit disposed in the housing to face the cover in the closed state, the image forming unit comprising:

a plurality of rotatable photoconductive bodies arranged along the first direction, each of the plurality of photoconductive bodies being configured such that an electrostatic latent image is formed thereon, the plurality of photoconductive bodies comprising:

a first photoconductive body configured to rotate around a first axis line parallel to the second direction; and a second photoconductive body opposed to the rotational shaft across the first photoconductive body in the first direction, the second photoconductive body being configured to rotate around a second axis line parallel to the second direction; and a first development cartridge configured to accommodate development agent to be supplied to the first photoconductive body; and a second development cartridge configured to accommodate development agent to be supplied to the second photoconductive body; and a plurality of exposure heads attached to the cover, the plurality of exposure heads comprising:

a first exposure head configured to expose the first photoconductive body; and a second exposure head configured to expose the second photoconductive body, wherein in the closed state, a distance between the first exposure head and the first development cartridge in the first direction is longer than a distance between the second exposure head and the second development cartridge in the first direction.

* * * * *